US005531530A

United States Patent [19]

Kuramoto et al.

[11] Patent Number: 5,531,530

[45] Date of Patent: Jul. 2, 1996

[54] PRINTER AND A METHOD OF SORTING OUT AND CUTTING PAPERS PRINTED THEREBY

[75] Inventors: Mitsuo Kuramoto; Seiji Fujioka; Nobuhiko Nii, all of Osaka-fu; Kimio Watanabe, Miyagi-ken; Yutaka Shibata, Miyagi-ken; Isamu Suzuki, Miyagi-ken; Daisuke Saito, Tokyo-to; Hideaki Matsuda, Miyagi-ken, all of Japan

[73] Assignees: Nitto Denko Corp., Ibaraki; Tohoku Ricoh Co., Ltd., Shibata-gun, both of Japan

[21] Appl. No.: 500,128

[22] Filed: Jul. 10, 1995

Related U.S. Application Data

[63] Continuation of Ser. No. 178,549, Jan. 7, 1994, abandoned.

[30] Foreign Application Priority Data

Jan. 12, 1993 [JP] Japan ..... 5-003514

[51] Int. Cl.[6] ..... B41J 11/66

[52] U.S. Cl. ..... 400/593; 400/73; 400/74; 400/621; 83/76.8

[58] Field of Search ..... 83/76.8, 76.7, 83/341, 76.1, 358, 361, 364, 365; 101/224, 226; 400/621, 621.1, 593, 103, 104, 107, 74, 73; 364/468, 474.16

[56] References Cited

U.S. PATENT DOCUMENTS

| | | | |
|---|---|---|---|
| 4,044,634 | 8/1977 | Kato | 83/76.8 |
| 4,327,615 | 5/1982 | Gerber et al. | 83/76.8 |
| 4,506,824 | 3/1985 | Baptz | 83/76.7 |
| 4,587,411 | 5/1988 | Obstfelder et al. | 400/74 |
| 4,799,413 | 1/1989 | Soderqvist | 83/76.8 |
| 4,981,059 | 1/1991 | Kobayashi | 83/76.7 |
| 5,000,069 | 3/1991 | Knobel | 83/341 |
| 5,042,340 | 8/1991 | Kasper | 83/76.7 |
| 5,315,398 | 5/1994 | Otsuki | 101/224 |

*Primary Examiner*—John S. Hilten

*Attorney, Agent, or Firm*—Armstrong, Westerman, Hattori, McLeland & Naughton

[57] ABSTRACT

In a printer comprising a printing means for performing printing on a continuous paper in response to a print data and a cutter unit for cutting the continuous paper in the paper width direction upon completion of printing, a printed paper needs to be sorted out easily and clearly depending on jobs. To meet the demand, the printer is provided with a rotary blade and a fixed blade which cut the continuous paper in the paper width direction which crosses perpendicularly to the paper feed direction and it is further provided with a carriage for holding the rotary blade so as to be movable in the paper width direction. The carriage has a shading piece. Sensors are disposed at the position corresponding to the position where the cutting amount of the paper in the paper width direction is set to be smaller than the entire paper width. When the sensors detect the shading piece, the rotary blade stops moving to thereby stop the cutting operation. As a result, the cutting operation with leaving uncut portion at one side of the paper in the paper width direction is performed depending on each job so that the cut papers range per job unit whereby the printed paper of one job is not mixed with other printed papers of other jobs and they can be easily distinguished from one another without resorting to a stacker.

9 Claims, 12 Drawing Sheets

PRINTER AND A METHOD OF SORTING OUT AND CUTTING PAPERS PRINTED THEREBY

This application is a continuation of application Ser. No. 08/178,549, filed Jan. 7, 1994, now abandoned.

FIELD OF THE INVENTION

The present invention relates to a printer provided with a printing means for printing a continuous paper strip and a cutter means for cutting the printed continuous paper strip in the paper width direction and a method of sorting out papers printed by the printer.

DESCRIPTION OF PRIOR ART

There is a method for sorting out papers, which are formed by cutting off a printed continuous paper strip in a given length depending on jobs such as described, e.g., in Japanese Patent Laid-Open Publication No. 52-17909 or Japanese Utility Model Laid-Open Publication No. 52-39211.

The method, comprising indicating a mark on the upper surface of the paper forming the boundary between jobs so as to extend to the side edge of the paper in the course of feeding the printed paper to a stack position, making the mark on the paper visible from the side view after the papers are stacked so that the boundary between the jobs can be distinguished by the mark.

There is a printer for printing a price tag, as disclosed in Japanese Patent Publication No. 63-24473, in which a printing mechanism is provided between a printing portion and a paper cutter portion.

That is, in this printer, a roller impregnated with ink is permitted to contact and apply ink to the side end surface of a continuous paper strip other than the surface on which printed subject matter, hereinafter referred to as "print data" is printed at the boundary of the jobs where the print data of the continuous paper strip having some thickness and forming a price tag is varied and the continuous paper strip is cut to sheets of paper based on the marks formed by the same ink and the sheets of papers are stacked on a stacker and the stacked papers are sorted out at boundaries of the jobs.

There is another method using a moving means for shifting a cut paper relative to a regular stack position upon completion of the printing wherein only the papers forming the boundaries of the jobs are shifted and stacked by the moving means, thereby sorting out the papers depending on jobs.

There is a portion on which the printer prints a symbol such as a bar code, etc., other than letters and numerals. If there is a void or spot in the bar code, there is a high possibility that it can be read by a bar code reader. If the bar portion is too thin or too thick, there is also a high possibility that the bar is wrongly read.

To overcome the problems, there are provided a verifying means for verifying whether a symbol, such as a bar code, etc. which is printed by a printing means, has such defect that it has a possibility not to be read or to be wrongly read, a means for reversing the paper having the defective bar code to a printing position when the verification means detects the presence of the defect and an invalid index forming means such as a stamper to print an invalid index such as a pattern or a mark representing invalidity on the paper having the defective bar code, which eventually prevents the use of the paper on which the defective bar code is printed.

However, a stacker is indispensable in case of marking the papers forming the boundaries of the jobs or shifting the stack position of the papers forming the boundaries relative to a regular position, thereby sorting out such papers.

Accordingly, there is such a problem in case of sorting out the papers distinctly depending on jobs upon completion of the printing that the printer and the stacker are necessary, which makes the apparatus large and also makes a total cost of the printer high.

In case of providing the verification means for verifying the symbol such as the bar code, etc., there is such a problem that if the presence of a defect is detected as a result of verification, the defective paper is reversed to the printing position and the invalid mark is printed on the defective paper, which results in a decrease of the entire processing speed of the printer.

Furthermore, in case of forming an invalid mark on the defective paper by the stamper, etc., the stamper and the means for moving the stamper between the printing position and a shunting position are needed, which generates the problems of increasing the cost of the printer by the stamper and the moving means.

SUMMARY OF THE INVENTION

The present invention has beer: made in consideration of the above problems, and has as its object to provide a printer capable of sorting out printed papers easily and clearly depending on jobs without need for a stacker.

It is another object to provide a printer which can cut the paper effectively, can prevent a defective paper from being used if there is a defective symbol, such as a bar code, which is printed on the paper and can dispense with reprinting again all the symbols which are the same as the defective symbols by reprinting the same symbol as the defective symbol on the next paper.

It is still another object to provide a printer which will not reduce the entire processing speed as a whole and can prevent the entire printer from costing high when the invalid index is formed to prevent the papers on which defective symbols are printed from being used.

To achieve the above object, the printer of the present invention is provided with a printing means and a cutter means, the printer is also provided with a cutting amount-deciding means for deciding the cutting amount of the continuous paper strip between an entire width extent or a width smaller than the entire width, and a cutter control means for operating a cutter means based on the cutting amount decided by the cutting amount-deciding means.

With such an arrangement of the printer, the continuous paper strip can be cut off in the entire paper width direction upon completion of the printing or cut in the width direction by an amount smaller than the entire paper width to thereby leave an uncut portion at one side of the paper in the paper width direction.

Accordingly, it is possible to distinguish the printed paper of one job from that of another job per job unit without providing a stacker if uncut portions are left at one side of the papers when cutting the paper strip within the same job and the paper strip is cut off in the paper width direction when cutting off the paper upon completion of each job.

There is a possibility that the continuous paper strip to be printed is liable to skew or get out of position from a regular alignment in the paper width direction depending on the variation of the paper width in each lot of papers or the variation of the set position of a paper guide for guiding the paper in the paper width direction.

Furthermore, there is a variation in the optic axis of an optical sensor in case that a stop position of a cutter of a cutting means is determined by an optical sensor when the paper strip is cut by cutting means leaving uncut portions.

Still furthermore, there is a possibility that a step angle is varied depending on a variation of load to be applied to a stepper motor in case that the movement of the cutter is performed by the stepper motor.

In such cases, there is a possibility that the portion to remain uncut will be cut off if the amount to remain uncut is set to be very small when cutting the paper with an uncut portion.

In such a case, if a cutting amount adjusting means is provided for adjusting the set value of the cutting amount by the cutting means which is smaller than the entire paper width, it is possible to adjust the set value while seeing the actual cutting amount, which always assures the desired uncut leaving amount.

If a cutter control means is provided with a means for arbitrarily changing the location of the uncut portion to either side of the paper in the paper width direction in case of cutting the paper with a residual uncut portion, the cutter means can operate in the manner of cutting off the paper in the entire width direction upon completion of one job, stopping the cutter at the position where it cut off the paper without returning to a home position, then starting to operate the cutter at the stop position to thereby cut the paper of the next job and leaving the uncut portion in the paper width direction at the side opposite to the uncut portion of the previous job, whereby the cutting time is shortened and the mechanical operability is improved.

If a cutting direction discrimination means for discriminating the cutting direction relative to the paper width and a print control means for changing the print data produced by the printing means in response to the result of discrimination in case of cutting the paper to produce a residual uncut portion, it is possible to align all the uncut portions relative to the printed data since the print control means changes the printing direction in response to the cutting direction even if the uncut portion is changed to be formed at one side or the opposite side of the paper in the paper width direction for shortening the cutting time.

Still furthermore, the printer may be provided with a verification means for verifying a symbol such as a bar code etc. which is printed by the printing means, a reprinting control means for permitting the printing means to reprint the same symbol as the defective symbol on the next printing portion of the paper when the defective symbol is detected by the verification means, and an invalidity indication operation control means for permitting the cutter means to crosscut the defective symbol on the printed paper for identifying the invalidity which is detected as defective by the verifying means.

With such an arrangement, the inferior printed paper which is detected as defective by the verification means can be distinguished from the other papers by the crosscut identifying the invalidation, whereby such an inferior paper can be removed and prevented from being used in advance.

Still furthermore, the same print data as the data which is printed on the inferior paper is reprinted at a moment on the next printing position of the paper by the reprint control means, which dispenses with remaking the papers by the number of inferior papers by reprinting the papers upon completion of all the printing so that labor can be saved.

The above and other objects, features and advantages of the invention will be apparent from the following detailed description which is to be read in conjunction with the accompanying drawings.

DETAILED DESCRIPTION OF THE PREFERRED EMBODIMENT

A preferred embodiment of the printer of the invention will be described in detail with reference to accompanying drawings.

First, an overall arrangement of a bar code printer forming the present printer and an operation of each component thereof at the normal printing operation will be described with reference to FIG. 2.

Figure 2:
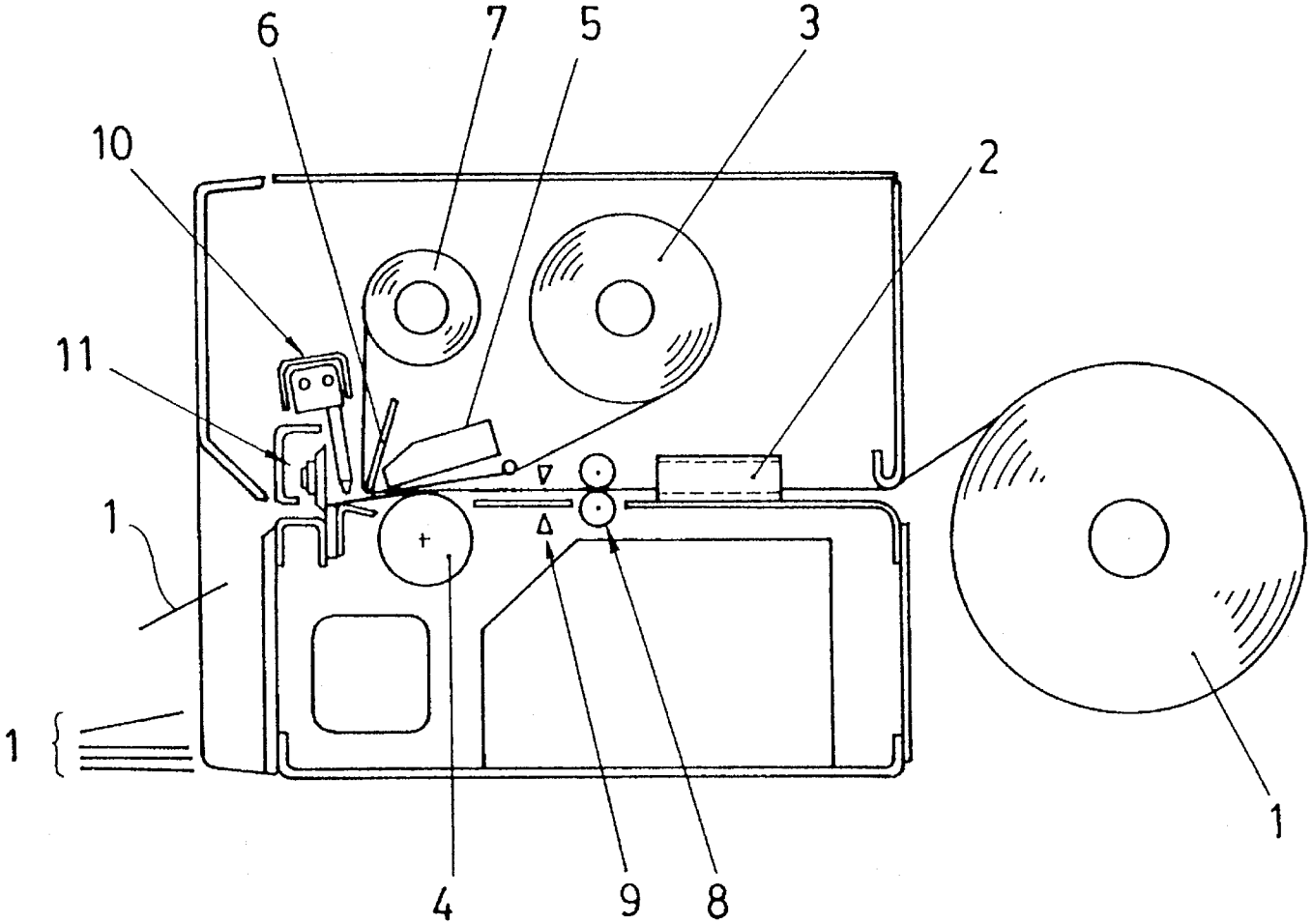
FIG. 2 is a view showing the schematic arrangement of an entire bar code printer forming the printer of the invention.

In FIG. 2, a continuous paper strip 1 which is wound in roll shape is restricted in the width direction thereof by a paper guide 2 which is provided in a printer body, then it is fed by a feed roller pair 8 and further fed together with an ink ribbon 3 to a printing portion constituted by a platen roller 4 and a thermal head 5 forming a printing means.

At this time, a leading end position of the paper strip 1 is specified by a sensor 9. In the printing portion, the ink ribbon 3 is melted by heat generated by the thermal head 5 and the melted portion is transferred to the paper 1 by a pressure application force of the platen roller 4, thereby forming a necessary image on the paper strip 1.

The paper strip 1 and the ink ribbon 3 which are stuck to each other are separated from each other by a peel plate 6 upon completion of the printing and the separated ink ribbon 3 is wound around a collection roller 7.

The printed paper 1 is verified by a verification unit 10 constituting a verification means whether the printed data is defective (inferior) or not. If the printed data is not defective, the printed paper strip is cut-off in a given length by a cutter unit 11 constituting a cutter means and is discharged out of the printer.

The aforementioned operations are the normal printing procedures where the paper strip 1 has not a defective printed data.

Figure 1:
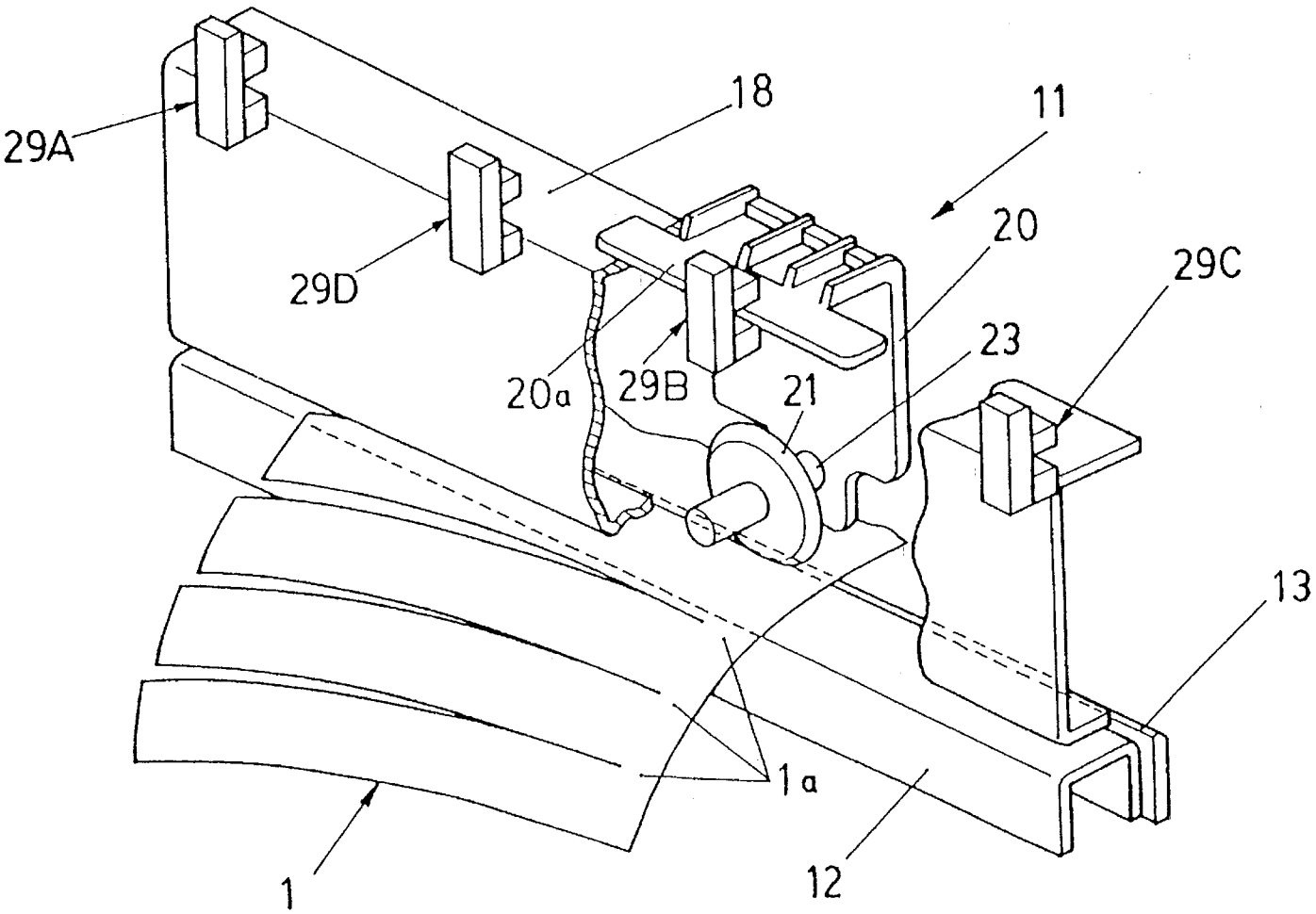
FIG. 1 is a perspective view of a cutter unit constituting a main portion of a printer and the portion adjacent thereto according to a preferred embodiment of the invention.
Figure 3:
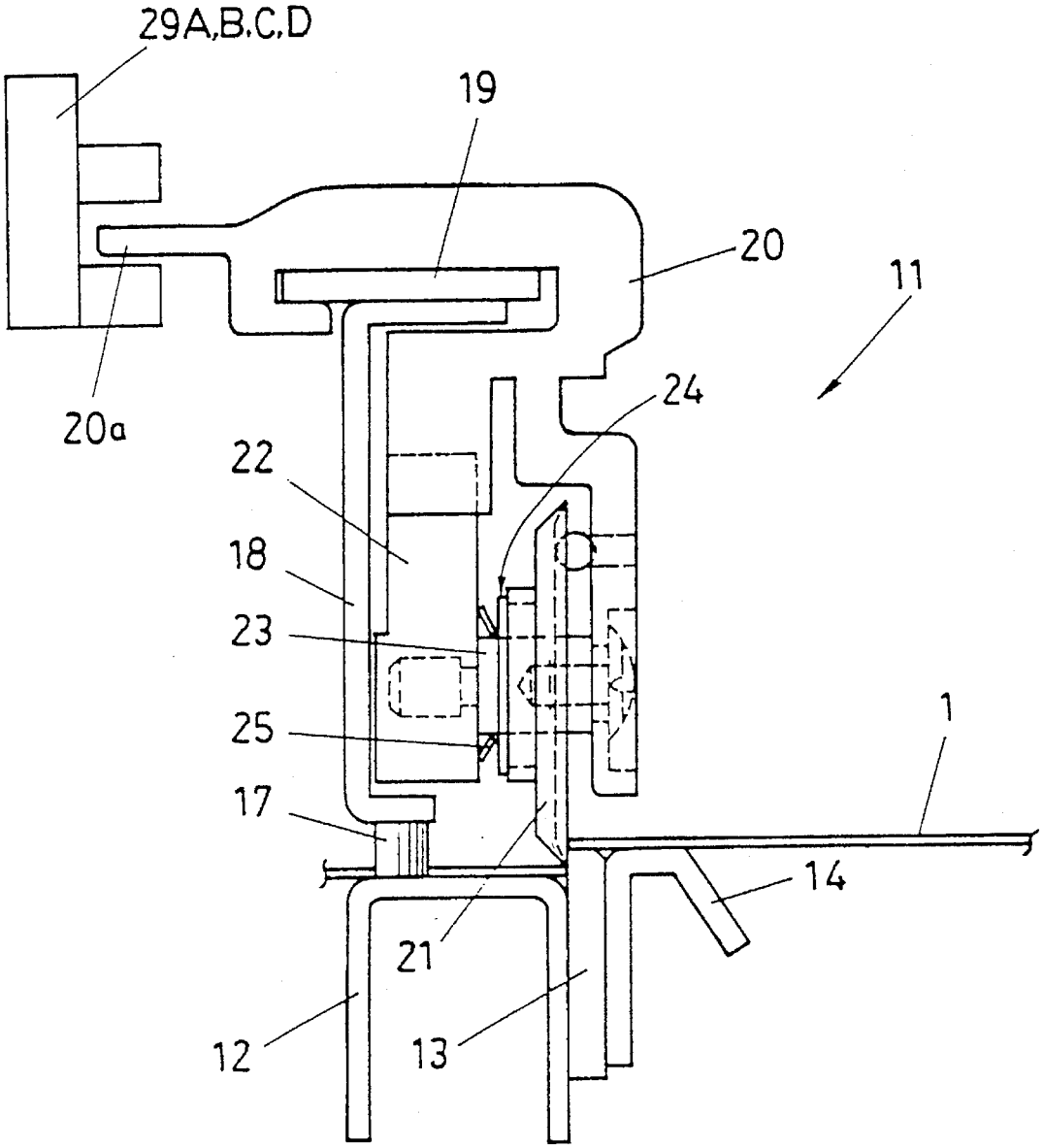
FIG. 3 is a side view showing the arrangement of the cutter unit of FIG. 1.
Figure 4:
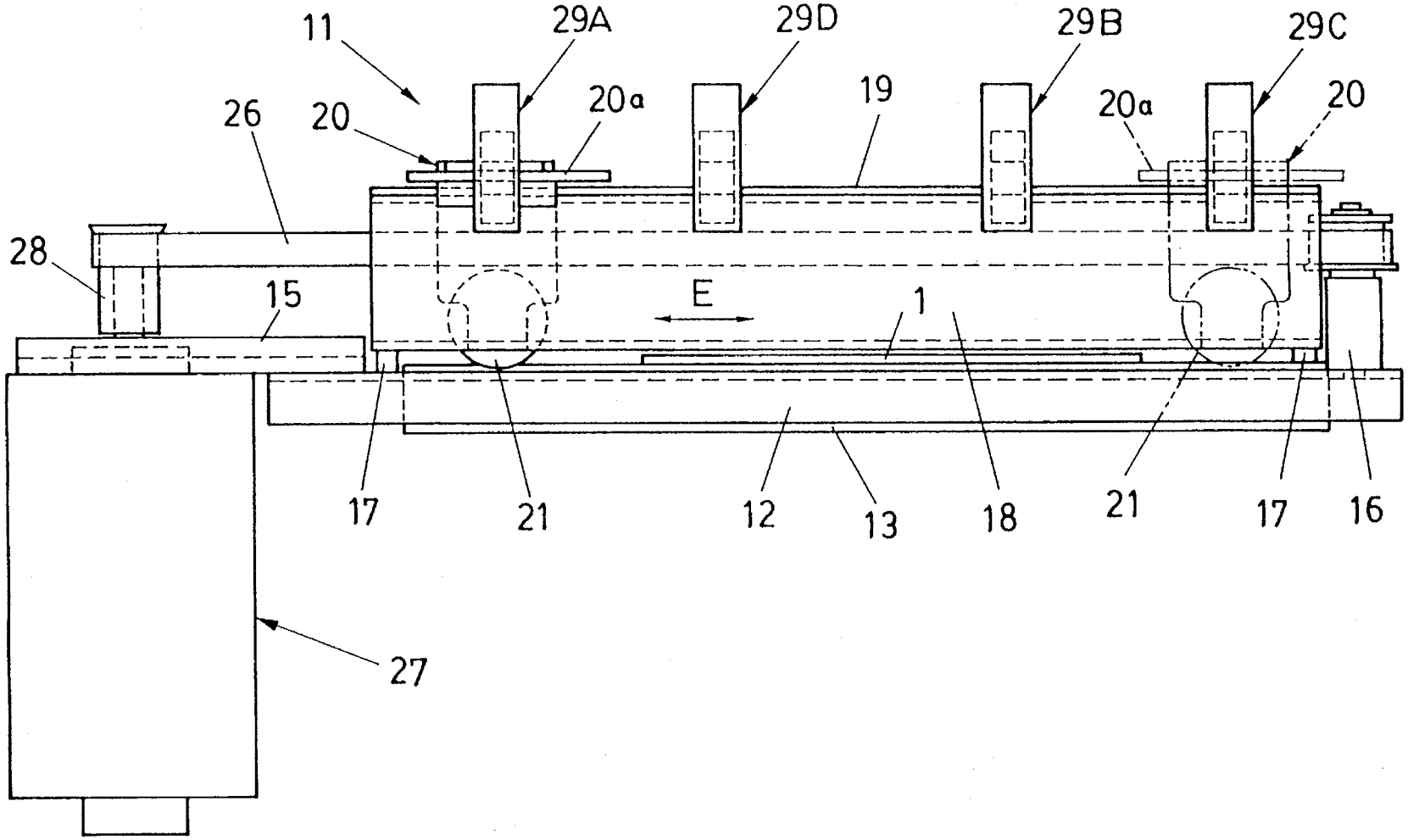
FIG. 4 is a left side view of the cutter unit of FIG. 3.

The cutter unit 11 is described more in detail with reference to FIGS. 1, 3 and 4.

The cutter unit 11 for cutting the continuous paper strip 1 in a given length comprises a body frame, not shown, and a lower frame 12 fixed to the body frame.

Fixed to the lower frame 12 are a fixed blade 13, an inlet lower guide 14 which are illustrated in FIG. 3, a motor bracket 15 and a driven pulley shaft 16 which are illustrated in FIG. 4. An upper frame 18 is disposed over the lower frame 12 by way of spacers 17.

The upper frame 18 has a U-shaped configuration, as illustrated in FIG. 3, and a carriage guide rail 19 is integrally fixed to the upper surface of the upper frame 18. A carriage 20 is engaged with the carriage guide rail 19 at the upper portion thereof and the former is slidably held by the latter so as to move in the direction of the arrow E in FIG. 4.

A holding frame 22 is detachably attached to the carriage 20 for holding a rotary blade 21 and the rotary blade 21 is rotatably attached by a ball bearing 24 which is fixed to the holding frame 22 and engaged slidably axially in a rotary blade shaft 23 as illustrated in FIG. 3.

The left side surface of the ball bearing 24 is pressed rightward in FIG. 3 by a conical spring 25 which is engaged in the rotary blade shaft 23 whereby the right end surface side of the lower portion of the rotary blade 21 is pressed toward the fixed blade 13.

The carriage 20 is fixed to a part of a timing belt 26 and is stopped at the left side as illustrated in FIG. 4 while it is restricted by a stopper, not shown, when it is stopped. When a cutter motor 27 starts to rotate, the timing belt 26 is turned by a driving pulley 28 fixed to the rotary shaft of the cutter motor 27 whereby the carriage 20 moves along the carriage guide rail 19 so that the paper 1 is cut off by the rotary blade 21 and the fixed blade 13.

The cutter motor 27 is controlled in its driving and stopping operations based on signals output from sensors 29A, 29B, 29C and 29D when the sensors 29A, 29B, 29C and 29D detect a shading piece 20*a* (which is clearly shown in FIG. 3) extended from the upper portion of the carriage 20.

The sensors 29A and 29C are disposed at the stop positions of the carriage 20 at left and right sides in FIG. 1. The sensors 29B and 29D are sensors for use in determining the stop positions of the carriage 20 at the time of cutting to produce a residual uncut portion, a detail of which will be explained later.

These sensors 29A, 29C and 29B and 29D are respectively formed of transmission type photosensors.

The sensor 29A detects the shading piece 20*a* of the carriage 20 when the carriage 20 holding the rotary blade 21 is positioned at a home position and also detects the shading piece 20*a* at the home position when the bar code printer (FIG. 2) starts and after the cutting operation stops.

The sensor 29C detects the shading piece 20*a* when the rotary blade 21 cuts off the paper in the entire paper width direction and reaches a return position.

The sensor 29B is positioned at the stop position at the time of cutting to produce a residual uncut portion on the paper 1 and is attached to a holding member, not shown, so that the sensor 29B is adjustably movable along the holding member in the direction of the arrow E which is the same as the moving direction of the carriage 20 as illustrated in FIG. 4.

The sensor 29D is necessary when the location of the residual uncut side is changed to either side of the paper in the paper width direction in case of cutting the paper to produce a residual uncut portion, but it is unnecessary when the location of the residual uncut portion is not changed, a detail of which will be described later.

The sensor 29D is also attached to the holding member and adjustably movable along the holding member in the moving direction of the carriage 20, like the sensor 29B.

Accordingly, if the sensors 29B and 29D are adjustably movable in the direction of the arrow E, as illustrated in FIG. 4, the cutting amount can be adjusted at the time of cutting to produce a residual uncut portion on the paper. That is, according to the preferred embodiment, the sensors 29B and 29D, which are adjustably movable, and the holding member for holding them serve as a cutting amount adjusting means.

The carriage 20 is controlled in its stop timing in the manner that the shading piece 20*a* is positioned at substantially the center of the paper width direction and a part of the shading piece 20*a* corresponding to the center of the rotary blade 21 serves as a sensing position of the sensors 29A to 29D when the shading piece 20*a* is detected by either of the sensors 29A to 29D.

The bar code printer can cut off the paper in the entire paper width direction or cut the paper leaving an uncut portion on either side of the paper in the width direction thereof.

When the cutting operation to produce residual uncut portions (hereinafter referred to as a halfcut operation) is selected, the cutting length is determined by the position of the sensor 29B or 29D for deciding the stop position of the rotary blade 21 in the paper width direction and this position can be adjusted by moving the sensor 29B or 29D.

The halfcut operation is convenient in case that the same kind of data are continuously printed on the paper depending on each job and adjoining printed portions are half cut wherein the halfcut adjoining printed portions are kept as they occur, namely, as they are half cut until they are used and they are used as a separate paper by sequentially cutting off the uncut portions when used.

For example, they are convenient when applied to an exchange ticket to be used by a cleaning shop. That is, a clerk of the cleaning shop must keep a plurality of clothes of different types without fail which are brought into the cleaning shop by a customer and returns the cleaned clothes to the same customer with assurance after a couple of days.

Although the time when the customer drops in the cleaning shop is concentrated at the time before she goes to her office or when she returns from her office, even at such times the clerk needs to keep the clothes without fail and without making her wait and also needs to return the cleaned clothes to the same customer a couple of days later.

Figure 5:
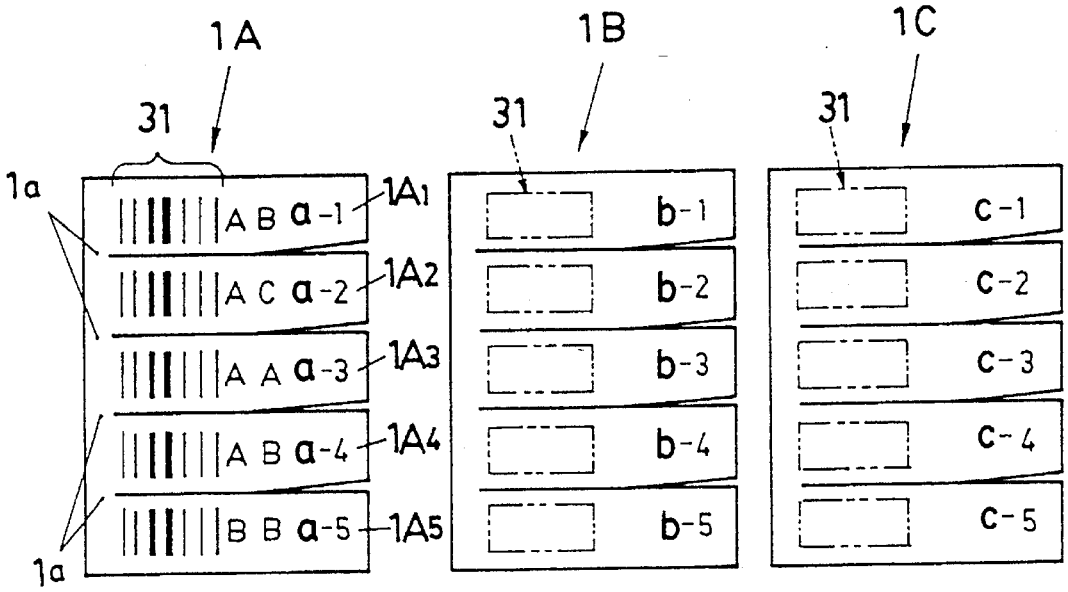
FIG. 5 is a schematic view showing three papers respectively having their jobs which are half cut by the cutter unit of FIG. 1 leaving a residual uncut portion.

To meet the need, the exchange tickets corresponding to the exchange coupons, which were delivered to the customer when the clerk kept a plurality of clothes of different kinds, need to be sorted out for each customer (corresponding to one job) at the time when she leaves the clothes into the cleaning shop and also need to be quickly attached to the clothes not to be detached from the clothes. To cope with this, the continuous paper strip needs to be cut off in the entire paper width direction per job unit and separated in the manner of forming a paper 1A for a first job, a paper 1B for a second job, a paper 1C for a third job (bar codes on the paper C are simplified like the paper 1B), . . . as illustrated in FIG. 5. Within each job, the paper is half cut leaving uncut portions 1*a* at one side of the paper in the paper width direction wherein a plurality of exchange tickets 1A1 to 1A5 on which bar codes 31, etc. are printed occur so as to be separable and they are separated manually and attached to the clothes when used.

Figure 6:
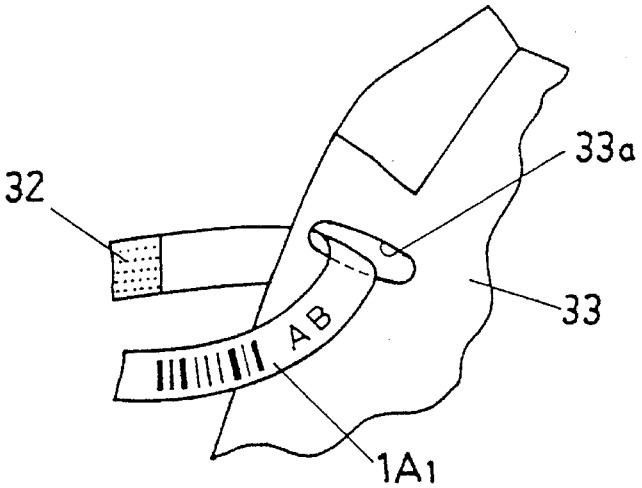
FIG. 6 is a schematic view showing an example of an exchange ticket which is formed by the halfcut paper of FIG. 5 and used by a cleaning shop.
Figure 7:
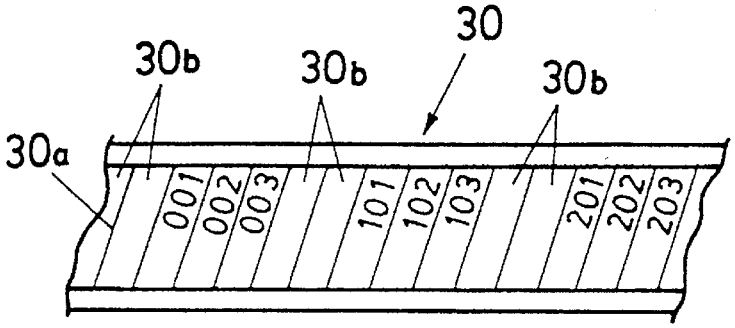
FIG. 7 is a perspective view of a prior art special paper having slits thereon.

For example, a pressure sensitive adhesive double coated tape 32 is beforehand stuck to a non-printing surface side (reverse side) of the paper 1A as illustrated in FIG. 6. When the clerk keeps the cloth, e.g. a shirt from the customer, the clerk cuts off only the fist exchange ticket 1A1 out of the paper 1A representing one job and inserts it into a buttonhole 33*a* of the shirt and loops it then sticks non-printing both ends of the exchange ticket 1A1 by the adhesive double coated tape 32. At this time, if the clerk also keeps slacks from the same customer, the clerk cuts off the second exchange ticket 1A2 out of the paper 1A and inserts it into a band looper and loops it like the shirt and sticks non-printing both ends of the exchange ticket 1A2 by the double coated tape 32.

In such a manner, it is possible to easily sort out the paper depending on each job if the paper having the same kind of printed data which range in the paper feed direction so as to be sequentially cut off and used.

Whereupon, the bar code printer is provided with a cutting amount adjusting means for adjusting the cutting amount of the continuous paper strip in the paper width direction to the entire paper width or to a paper width smaller than the entire paper width based on a cutting condition of the paper, etc. which are input when an operator operates keys on an operation panel, not shown, and a cutter control means for permitting the cutter unit 11 to operate based on the cutting amount determined by the cutting amount adjusting means. There is a main control portion 40, described later with reference to FIG. 13, as the cutting amount adjusting means. There is a cutter control portion 43 in FIG. 13 as the cutter control means.

According to the printer having such a structure, the paper 1 in the continuous state, as illustrated in FIG. 2, is cut off in the entire paper width direction per each piece upon completion of the printing by the thermal head 5 or it is half cut with residual uncut portions la at one side of the paper width direction within one job, as explained with reference to FIGS. 1 and 5.

Figure 10:
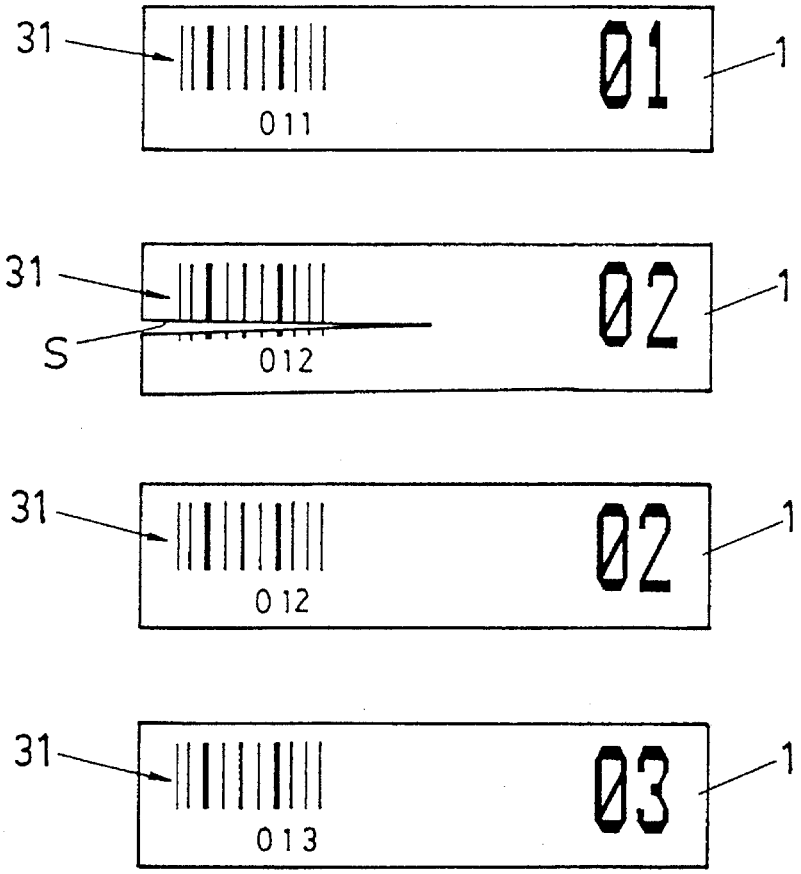
FIG. 10 is a schematic view showing the state where the paper is half cut at the portion where a defective bar code is detected by the verification unit of FIG. 9 and also showing the state where the same print data as the defective bar code is reprinted on a next paper.

If the printed bar code is inferior, which will be described more in detail later with reference to FIG. 10, the bar code on the paper is crosscut to an extent corresponding substantially to the half of paper width to form the crosscut S representing the invalidity, thereby preventing the paper having the defective bar code from being used.

Described hereinafter is the operation of each component when performing the halfcut operation leaving uncut portions la at one side of the paper in the paper width direction depending on each job like the papers 1A to 1C, as illustrated in FIG. 5.

As illustrated in FIG. 4, the rotary blade 21 is positioned at the home position at the first state where the shading piece 20*a* formed on the carriage 20 for holding the rotary blade 21 (clearly shown in FIG. 3) shades the detection portion of the sensor 29A.

When the cutter motor 27 is driven, the timing belt 26 is turned so that the rotary blade 21 is moved together with the carriage 20 rightward in FIG. 4, where the cutting of the paper 1 starts. When the rotary blade 21 is further moved to the position corresponding to the sensor 29B, the sensor 29B detects the shading piece 20*a* of the carriage 20 and issues a detection signal in response to which the cutter motor 27 stops. Immediately after the cutter motor 27 stopped, the cutter motor 27 is reversely rotated so that the rotary blade 21 is returned again to the home position in the halfcut state where the uncut portions la are left at one side of the paper in the paper width direction (refer to FIG. 5).

A series of these operations are repeated by the set number of times. As a result, the halfcut operations leaving the uncut portions la at one side of the paper in the width direction are performed sequentially. Upon completion of the halfcut operations depending on a series of jobs, the rotary blade 21 is moved toward the sensor 29C so as to cut off the paper 1 in the entire paper width direction.

Thereafter, the sensor 29C detects the shading piece 20*a* of the carriage 20 and issues a detection signal in response to which the cutter motor 27 is reversely rotated so that the rotary blade 21 is returned together with the carriage 20 to the home position where the sensor 29A is positioned.

Since the sensor 29B is adjustably movable in the paper width direction, it is adjusted in advance to be positioned to obtain a desired uncut leaving amount.

In such a manner, as illustrated in FIG. 5, the paper 1A is prepared with the uncut portions la at either side of the five-in-a-set exchange tickets 1A1 to 1A5. Likewise, the papers 1B, 1C, . . . can be prepared. Accordingly, since the paper 1 is prepared in the manner that the papers 1A, 1B, 1C, . . . whose number depend on each job, there is no possibility that the exchange tickets 1A, 1B having different jobs are mixed with each other when they are loose. As a result, the prepared papers can be easily sorted out without resorting to the prior art stacker provided with a complex mechanism having the function to sort out the papers.

Whereupon, there is a paper having perforations among the papers on which the bar code, etc. are printed. Although such a paper has a advantage that it can be separated easily along the perforations but has such problems that it is high in cost and a printing quality is deteriorated in case that a paper powder which is generated from the perforations is stuck to the printing portion.

In case of printing the continuous paper having no perforations, the continuous paper strip is once wound around a roller, not shown, upon completion of the entire printing on the continuous paper and it is cut between jobs by scissors, etc. Alternatively, upon completion of the printing on the cut sheet paper having one job length which is prepared beforehand, a cutter member having the shape of the teeth of a comb is attached to a press cut device which has a function to cut the paper like a halfcut operation as illustrated in FIG. 1, whereby the paper is crosscut like a halfcut operation by the cutter member, which results in requiring the complex working and many steps.

Furthermore, since there is provided a label 30 having slits 30*a* and non-printing portions 30*b* which are provided at partitioning portions of jobs and manually cut later, the label 30 is however expensive because it has many slits and it is uneconomical since the non-printing portions are wasted.

However, according to the preferred embodiment, the cutter unit 11 which is incorporated in advance in the bar code printer cuts off the paper depending on one job and also performs the halfcut operation like the teeth of a comb depending on each number of pieces within one job, which dispenses with the paper having the perforations and the special label having many slits. Instead, an ordinary paper is used, which makes the cost low.

Furthermore, since the paper is half cut during the discharge thereof, it is possible to issue a label, a coupon, etc., for one job instantaneously.

Since the positions of the sensors 29B and 29D for deciding the residual uncut amount at the time of halfcut operation are adjustably movable to move in the direction of the arrow E, as illustrated in FIG. 4, there is no possibility that the paper will be entirely cut off. By appropriately adjusting these positions, the position of the uncut portion can be shifted from the side edge of the paper 1 or the stop position of the carriage 20 can be shifted in the width direction in case that the residual uncut amount is set to be very small. That is, the paper to be printed is liable to skew due to the variation of the paper width between the lot of papers or due to the variation of the setting position of the paper guide for guiding the paper in the paper width direction even if there is no variation of the paper width. Furthermore, there is a possibility that the stop position of the carriage 20 is shifted in the width direction due to the variation of the optic shaft of the sensors 29B and 29D and the like.

Accordingly, in case that the residual uncut amount is set to be very small, there is a possibility that the paper is cut off in the entire paper width direction although the uncut portion is intended to be left due to the shifting of the paper or optic axis of the sensor in the paper width direction.

However, according to the preferred embodiment, since the cutting amount can be easily adjusted by adjusting the position of the sensor 29B, even in such an aforementioned case, the halfcut operation, i.e., the cutting to produce a desired residual uncut amount can be performed with assurance. The adjustment of the cutting amount at the time of halfcut operation can be easily performed by adjusting the cutting position to which the rotary blade 21 is moved and by controlling the number of steps of the stepper motor, if the cutter 27 is composed of a stepper motor.

In this case, if a switch for adjusting the cutting amount is beforehand provided on the operation panel having various functions and setting switches, not shown, the operator can easily adjust the cutting amount by changing the setting value or step of the switch at the time of halfcut operation and by minutely adjusting the number of steps of the stepper motor.

For example, if three dip switches are provided, eight pattern settings are possible. That is, it is possible to minutely adjust the cutting amount matching with actual cutting condition provided that one pattern is defined as ±0 step, remaining three patterns are defined as +1 to +3 steps and the remaining four patterns are defined as −1 to −4 steps.

In such a manner, if the cutter motor 27 is composed of the stepper motor so that the cutting amount can be adjusted at the time of halfcut operation, it is possible to assure a desired residual uncut amount by adjusting the number of steps of the stepper motor even if a step angle is varied due to the variation of the load to be applied to the stepper motor.

Whereupon, in case of performing the halfcut operation as illustrated in FIG. 5 whereby the paper range depends on a job unit, the rotary blade 21 moves together with the carriage 20 from the position of the sensor 29A which forms the home position to the position of the sensor 29B where the halfcut operation is performed. Thereafter, the rotary blade 21 repeats the operation to return to the position of the sensor 29A depending on the range of the job units and then it moves to the position of the sensor 29C for cutting off the paper in the entire paper width direction at the boundary of the next job and finally it returns to the home position where the first sensor 29A is positioned. Accordingly, the operation of the rotary blade 21 to return to the home position together with the carriage 20 upon completion of the halfcut operation within one job does not influence seriously upon the entire processing time in case that the number of halfcut operation within one job is sizable to some extent. However, in case that the number of halfcut operations within one job is small, the carriage 20 is returned frequently every time the halfcut operation within one job is completed so that the time to return to the home position is wasted as a whole, which lowers the working efficiency.

According to the preferred embodiment, there is provided a means for arbitrarily changing the location of the uncut portion to be left to either side of the paper in the paper width direction at the time of halfcut operation. Accordingly, if the number of halfcut operations within one job is small, the carriage 20 does not return to the first home position but remains positioned at the position where the paper is cut off in the entire paper width direction upon completion of the cutting operation within one job and it moves from the same position forming the home position to the opposite side in the width direction for starting the halfcut operation of the next job.

That is, as illustrated in FIG. 4, the sensor 29D is disposed symmetrically relative to the sensor 29B in the paper width direction between the left and right sensors 29A and 29C. When the cutting operation starts from the side of the sensor 29A and the sensor 29B detects the shading piece 20*a* of the carriage 20, the halfcut operation for returning the carriage 20 again to the position of the sensor 29A is performed. Upon completion of one job, when the carriage 20 is moved to the position of the sensor 29C so as to cut off the paper in the entire paper width direction, the second job starts at the position of the sensor 29C. When the sensor 29D detects the shading piece 20*a* of the carriage 20, the halfcut operation for returning the carriage 20 again to the position of the sensor 29C is performed.

Figure 8:
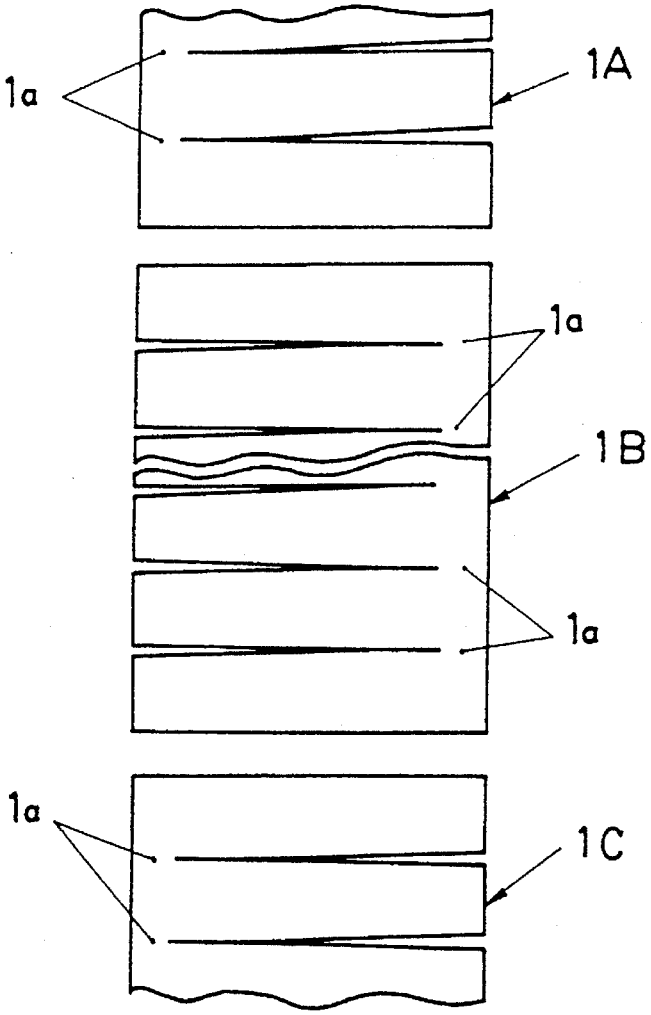
FIG. 8 is a schematic view showing papers which are respectively half cut in the manner that residual uncut sides alternate depending on jobs.

In such a manner, if the carriage 20 is moved to the position of the sensor 29A upon completion of the second job, the third job starts at the position of the sensor 29A. Accordingly, the halfcut operations are performed in the manner that the uncut portion sides la are arranged alternately depending on jobs of the papers 1A to 1C . . . , as illustrated in FIG. 8.

The operation to change the location of the uncut portion to either side of the paper in the paper width direction may be performed by pushing operation buttons on the operation panel which externally instruct a main control portion, described later. Suppose that the number of halfcut operations is four within one job, the operation to change the location of the uncut portion to either side of the paper in the paper width direction may be automatically performed if the number of halfcut operations is one to three but the operation to change the location of the uncut portion to either side of the paper in the paper width direction may not be performed if the number of halfcut is four or more.

In case that the uncut portion sides are arranged alternately between one side and the opposite side, the detection signals which are issued two times by the sensor 29B or 29D for detecting the halfcut position until the carriage 20 reaches the halfcut position even if the cutting operation starts from either side of the sensor 29A or 29C in which the either side of the sensors 29A or 29C become the left or right home position.

If the cutting direction is controlled every time the halfcut operation is performed, it is easily judged whether the carriage 20 is stopped and returned to either side of the sensor 29A or 29C depending on the output signal from the sensor 29B or 29D. Suppose that the halfcut position to be stopped is always set at the time when the second time detection signal is issued from the sensor 29B or 29D, the carriage 20 can be stopped and returned to the intended halfcut position to perform the halfcut operation even in the case that the halfcut operation starts from either side of the sensor 29A or 29C, thereby a desired cutting can be performed.

Whereupon, the bar code printer comprises, as illustrated in FIG. 2, the verification unit 10 as the verification means for verifying the symbol such as the bard code which is printed on the paper by the thermal head 5 forming the printing means, a reprint control means for reprinting the same symbol as a defective symbol on the next paper when the detective symbol is detected by the verification unit 10 and the invalidity indication operation control means for permitting the cutter unit 11 to crosscut the bar code for representing the invalidity which is detected as defective by the verification unit 10.

The verification unit 10 verifies whether the bar code is correctly printed or not if the printed data includes the bar code. That is, there is a possibility that the printed bar code is inferior so that it can not be read later by a bar code reader. In such a case, the verification unit 10 detects such a inferior bar code to prevent the printed ticket or the label, etc., from being issued.

Figure 9:
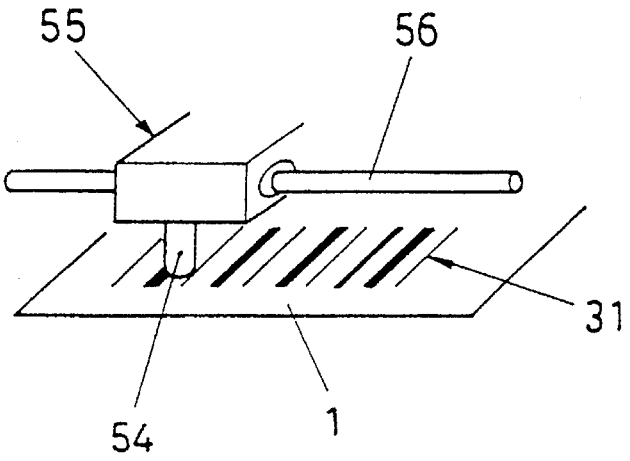
FIG. 9 is a perspective view showing a verification unit provided in the bar code printer of FIG. 2.

The verification unit 10 includes, as illustrated in FIG. 9, a carrier 55 on which a pen type scanner 54 is mounted wherein the carrier 55 moves along a guide shaft 56 when it is driven by a drive motor, not shown so that the bar code 31 is read by the scanner 54.

There may be provided a system to read the bar code 31 utilizing a CCD line image sensor, not shown.

Figure 13:
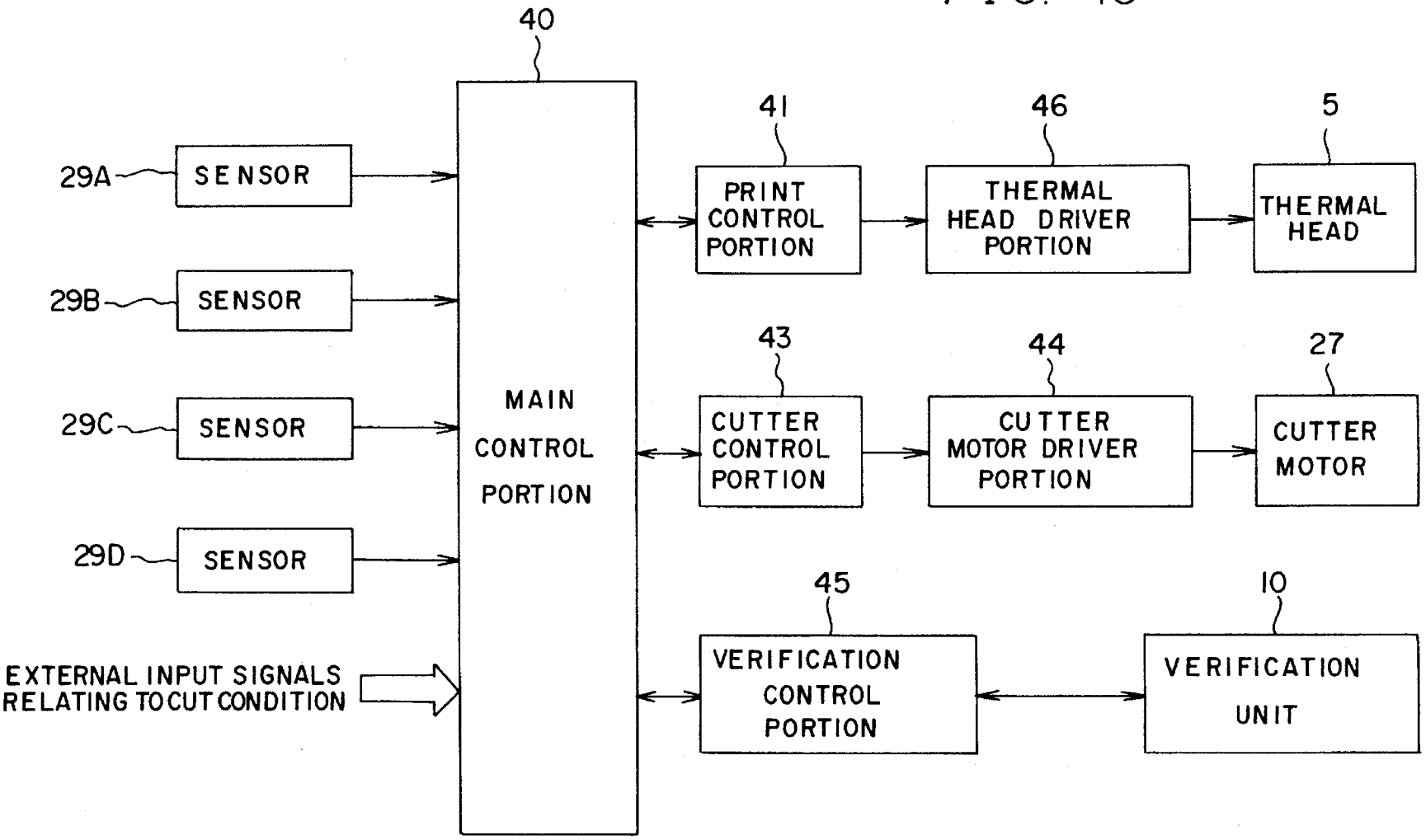
FIG. 13 is a block diagram showing a control system of the printer.
Figure 14:
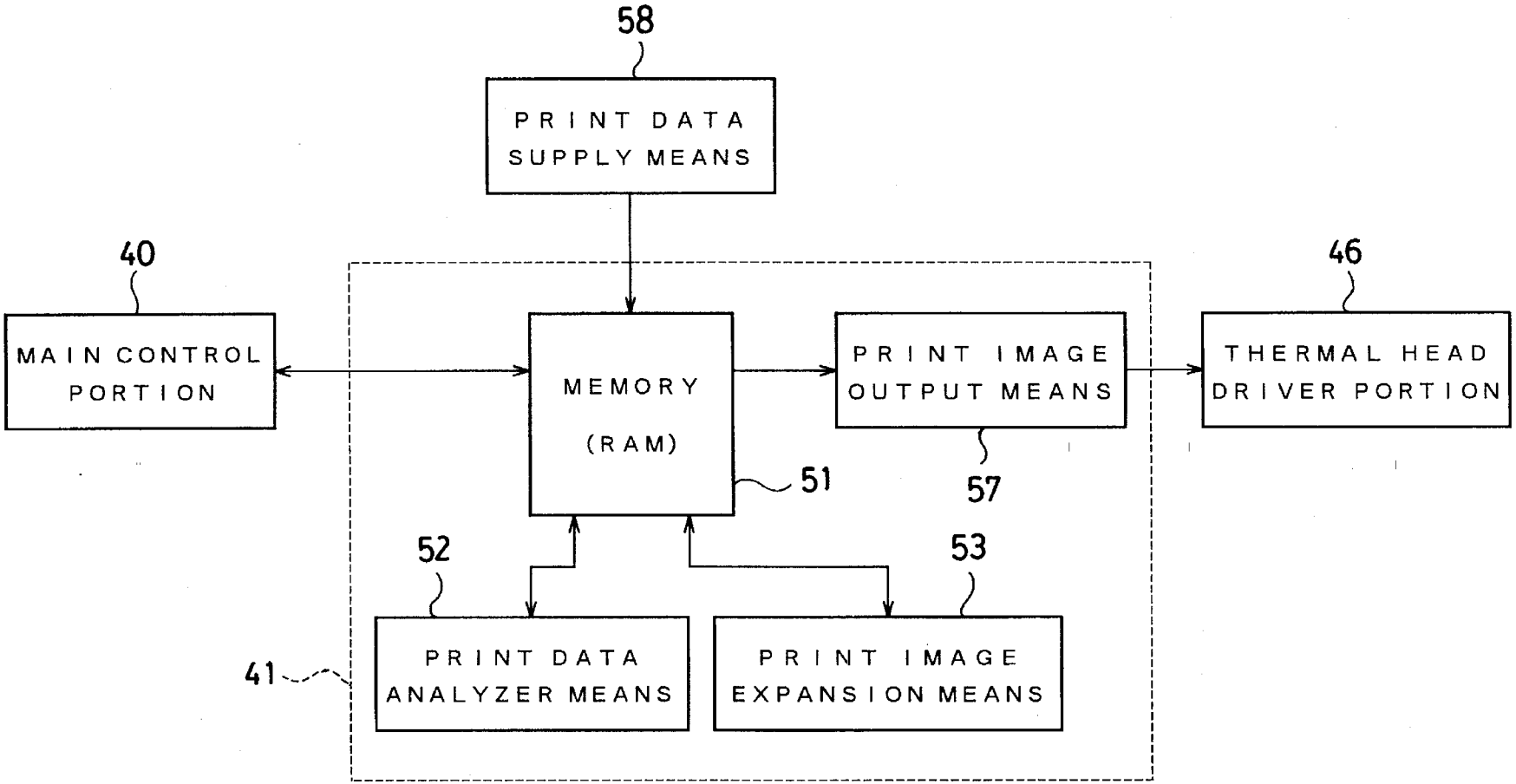
FIG. 14 is a block diagram showing the print control portion and its related arrangement of FIG. 13.

The read data is digitized and the digitized data is supplied to a verification control portion 45 (FIG. 13). The verification control portion decodes the digitized signal and collates the decoded signal with an input data (data to be printed), thereby judges whether the input data is a normal print data or not, namely, it can be read and has no defect.

If the result of verification shows that the bar code is normal, the bar code 31 can be read later by the bar code reader so that the paper 1 is discharged as it is. If the result of verification shows that the bar code is abnormal, namely, when the defective bar code 31 is detected, the cutter unit 11 crosscuts the bar code 31 to form a crosscut S representing the invalidity which extends to substantially the half of the paper width as illustrated in the second paper 1 in FIG. 10. The reprint control means informs an operator that the paper has the defective bar code and permits the thermal head 5 (FIG. 2) to reprint the same bar code as the defective bar code on the third paper in FIG. 10.

In such a manner, the paper on which the inferior bar code is printed can be clearly distinguished from the other papers, thereby preventing the paper having such an inferior bar code from being used. Furthermore, since the same bar code as the defective bar code is reprinted on the paper next to the paper having the inferior bar code, which dispenses with the reprinting operation by the papers having the inferior bar codes upon completion of the printing entirely. Accordingly, time and labor is saved.

If the papers having the inferior bar codes are continuously issued by the predetermined set number, the reprint control means recognizes that the thermal head 5 is broken or troubled due to some cause so that it informs that operator the abnormal bar code, then stops all the operations of the printer.

In case of forming the crosscut S representing the invalidity by crosscutting the bar code until it extends to substantially the half of the paper width different from the case where the uncut portion is left in either side of the paper in the paper width direction, a sensor for forming the crosscut S representing the invalidity, not shown, is necessary in addition to the sensors 29B and 29D for detecting the halfcut position.

Although there is described that the crosscut S formed on the bar code 31 extends to substantially half of the paper width, it is expected that the inferior paper is invisible by a single crosscut S in case that the height of each cut paper (length in the paper feed direction) is high. In such a case, it is a matter of course to crosscut the inferior bar code to form the crosscut S and also it is possible to crosscut bar codes to form plural crosscuts S evading the normally printed bar code appearing on the inferior paper so that the inferior paper is quickly visible.

Figure 11A:
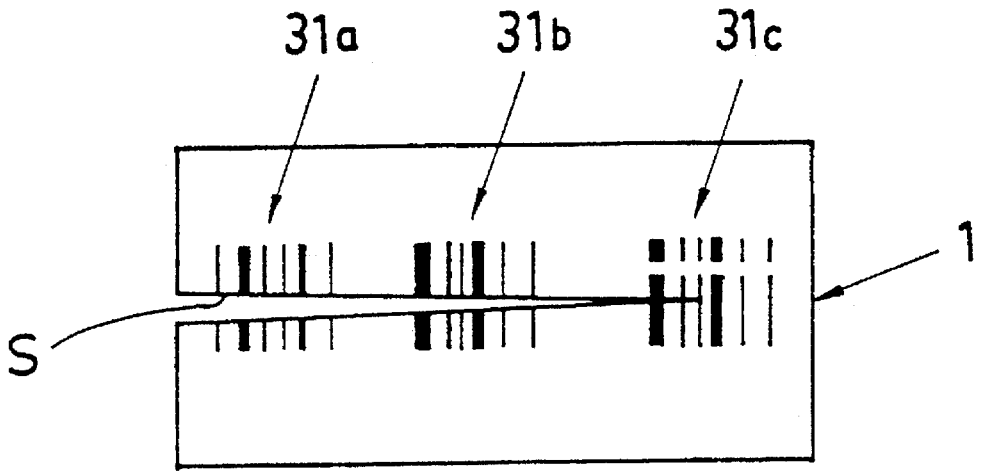
FIGS. 11*a* and 11*b* are schematic views showing the case of another example where a bar code at the stop position of a crosscut S is controlled as if it were defective bar code in case that a plurality of bar codes are arranged in the crosscut direction.
Figure 11B:
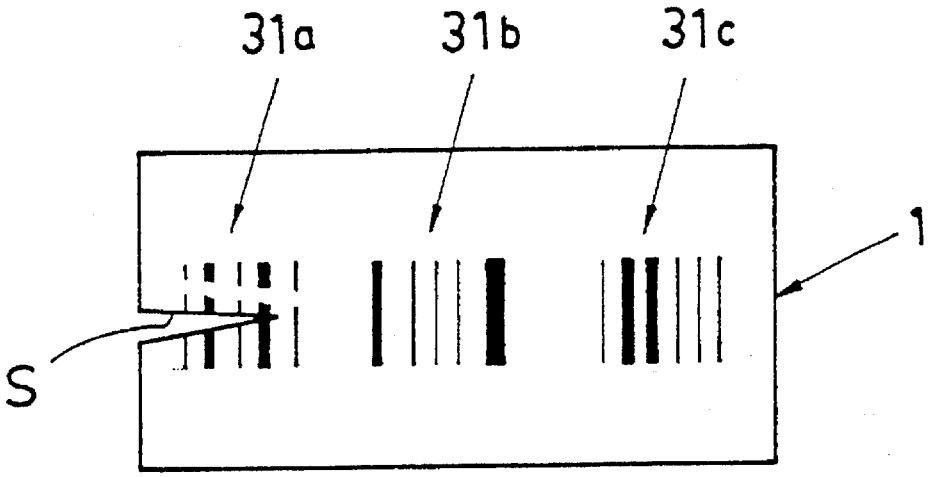

In case that a plurality of bar codes 31*a*, 31*b* and 31*c* are arranged on the line on which the crosscut S are formed as illustrated in FIGS. 11*a* and 11*b*, if the bar code at the stop position of the crosscut S is handled as if it were the bar code which was detected as defective, it is possible to specify the position of the bar code having the defect among those arranged on the same line so that the stop position of the crosscut is very effective for finding out the cause of the defect.

That is, in the case as illustrated in FIG. 11*a*, the crosscut S extends to the third bar code 31*c* so that the bar code 31*c* can be detected as defective at a glance. In this case, since the amount of the crosscut S needs to be controlled at the location where each bar code is positioned, the movement of the carriage 20 of the cutter unit 11 (refer to FIG. 4, etc.) is preferable to be controlled by the number of steps of the stepper motor.

Whereupon, the bar code printer of the invention is provided with a print control means for changing the printing direction corresponding to the cutting direction in the width direction. The print control means will be described hereinafter.

Figure 12A:
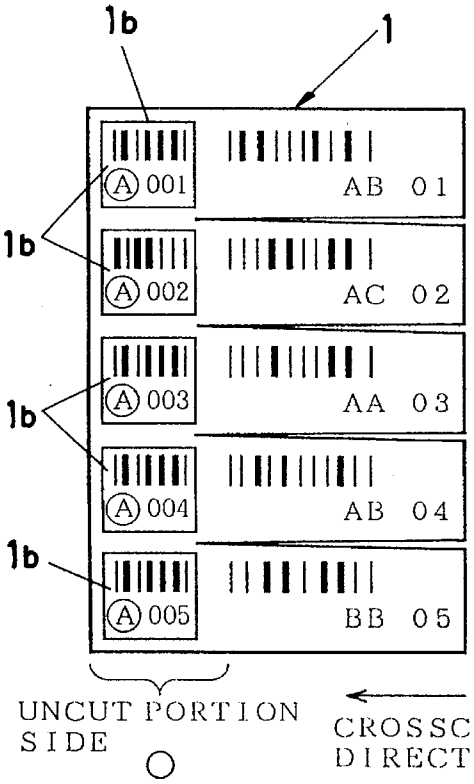
FIGS. 12*a*, 12*b* and 12*c* are schematic views of papers according to modifications of the invention wherein the printing directions of the papers are arranged to be aligned in response to the crosscut directions relative to the paper width direction.
Figure 12B:
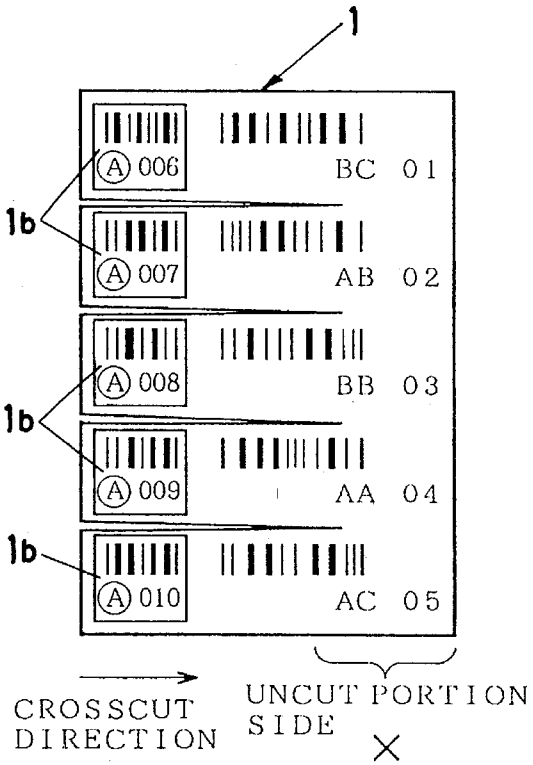

In case of improving the working efficiency by changing the uncut portion side depending on jobs at the time of halfcut operation to thereby shorten the cutting time as illustrated in FIGS. 4 and 8, there occurs an inconvenience when the print data or printing direction is decided relative to the crosscut direction. That is, in case of the printed data, as illustrated in FIG. 12*a* where the paper strip 1 is crosscut from the right to the left, the paper 1 needs to be kept by the person who issues the exchange ticket in the manner that it is manually cut off at the ends of the cross cut in the up and down directions, vertically in FIG. 12*a* so as to connect to counterfoils 1*b* which are kept by the same person. Otherwise, if the paper 1 is crosscut as illustrated in FIG. 12*b* from the side opposite to the side of the paper 1 of FIG. 12*a*, namely, from the left to the right in the paper width direction, the counterfoils 1*b* to be kept by the same person are loose, which fails in obtaining intended object.

However, since the printer of the invention is provided with a cutting direction discrimination means for discriminating the cutting direction relative to the paper width and the print control means for changing the print data produced by the thermal head 5 forming the printing means in response to the result of discrimination if the halfcut operation is performed according to the preferred embodiment, it is possible to print the data corresponding to the intended cutting direction even if the uncut portion sides are alternately arranged depending on jobs, a detail of which will be described later.

FIG. 13 is a block diagram showing the control system of the printer.

A main control portion 40 receives detection signals which are output from the sensors 29A to 29D when the sensors 29A to 29D detect the shading piece 20*a* of the carriage 20 (FIG. 3) and always controls the cutting direction of the paper by the rotary blade 21.

The main control portion 40 also receives external input signals relating to a cutting condition such as whether the paper is cut off in the entire paper width direction or half cut and the number of halfcut operations per job unit in case of halfcut operation when the keys and switches on the operation panel are operated by the operator.

The main control portion 40 exchanges signals between a print control portion 41 which functions as a print control means. The print control portion 41 outputs a signal for printing the data on the paper in the direction corresponding to the cutting direction to a thermal head driver portion 46 in response to the result of determination of the cutting direction which is supplied from the main control portion 40.

The cutter control portion 43 serving as the cutter control means outputs a signal for driving the cutter motor 27 to a cutter motor driver 44 in response to a signal which is output depending on the kind of cutting such as the cutting in the entire paper width direction or the halfcut operation, etc. and a signal for instructing the cutting direction which are respectively supplied from the main control portion 40.

A verification control portion 45 outputs a driving signal to a verification unit driver portion, not shown, for driving the carrier 55 on which the pen type scanner 54 serving as the verification unit 10 is mounted and verifies whether the data read by the verification unit 10 is not defective but normal in response to a signal issued by the verification unit 10 and issues the result of verification to the main control portion 40.

The main control portion 40 issues a signal for crosscutting the symbol such as a bar code, etc. to form the crosscut representing the invalidation in the symbol as explained with reference to FIG. 10 to the cutter control portion 43 and further issues a signal for reprinting the same print data as the defective printed data to the print control portion 41.

That is, according to this preferred embodiment, the main control portion 40 serves also as the invalidation indication operation control means and the reprint control means.

The print control portion 41 is composed of a memory (RAM) 51, a print data analyzer means 52, a print image expansion means 53 and a print image output means 57. The print data analyzer means 52 analyzes commands of the print data which are supplied from a print data supply means 58 to the memory 51 and the print image expansion means 53 expands the print image to a bit map in the image buffer of the memory 51. The print image output means 57 conforms the print image expanded to the bit mat to the print image every one line and outputs the print image to the thermal head driver portion 46 as the actual print image.

Figure 12C:
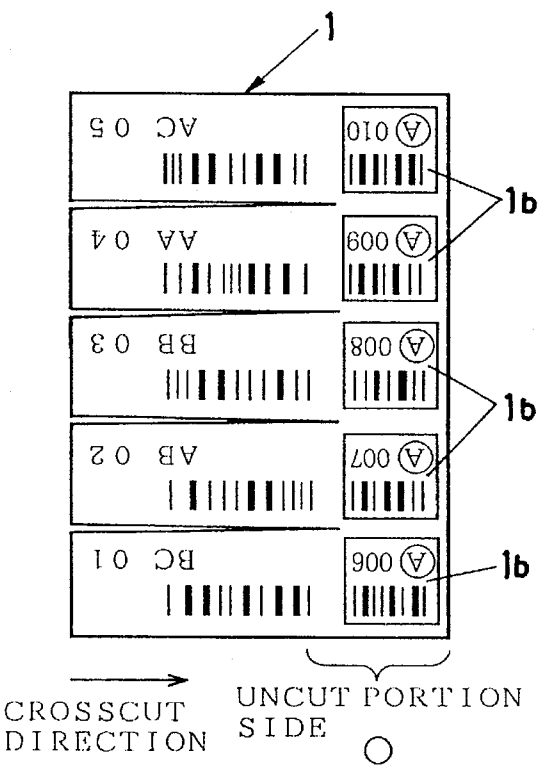

Suppose that the state as illustrated in FIG. 12*a* is subjected to the image expansion at the regular position of the image buffer, in case that the crosscut direction is changed at the next job as illustrated in FIG. 12*c*, the image is simply turned 180° at the regular position and expanded so that the printing can be performed at the correct position corresponding to the intended crosscut direction.

If the image expansion is always performed at the regular position as set forth above, the image data which was expanded in the image buffer is read from the reverse direction and output as the print image in case that the crosscut direction is changed from the regular position. In this case, it is possible to obtain the print image corresponding to the cutting direction without lowering the throughput if the work involved in reading the image from the reverse direction and outputting the read image is realized by a hardware not to lengthen the print cycle every one line.

Figure 15B:
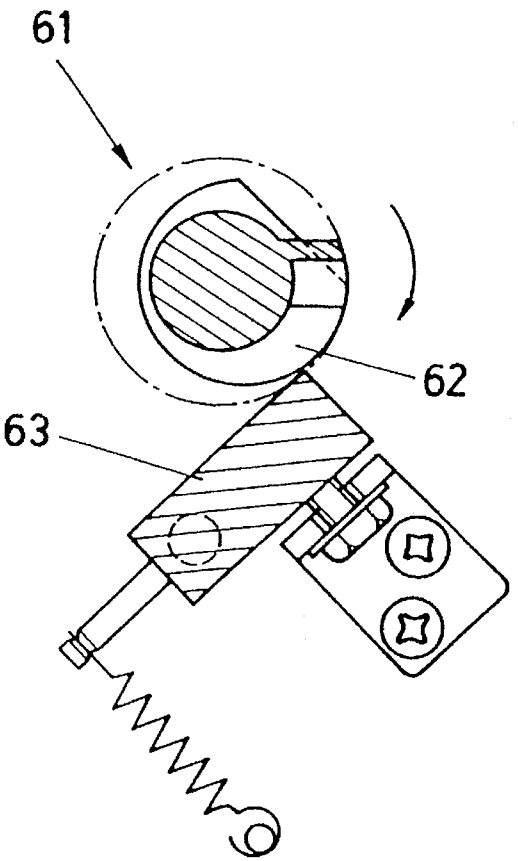
FIGS. 15*a* and 15*b* are a front view and a longitudinal cross-sectional view of the cutter unit according to modifications of the invention.
Figure 15A:
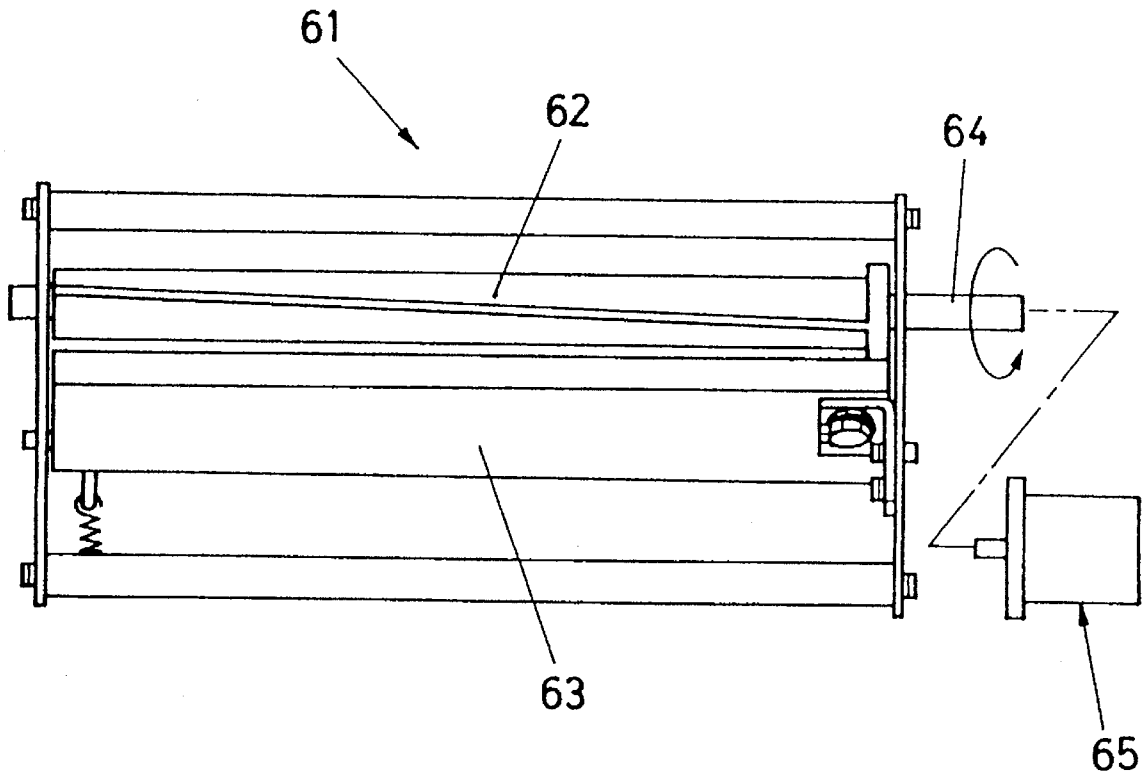

Although the cutter unit 11 having such an arrangement comprises the fixed blade 13 and the rotary blade 21 as illustrated in FIG. 3, it may be replaced by a rotary type cutter unit 61 comprising a fix blade 63 and a rotary blade 62 as illustrated in FIGS. 15*a* and 15*b* wherein the rotary type cutter unit 61 performs the same effect as the cutter unit 11. In the rotary type cutter unit 61, the cutting amount is controlled by the number of steps of a stepper motor 65 for rotating the rotary blade 62 by way of a shaft 64 whereby the stepper motor is rotated by the number of steps corresponding to a predetermined cutting amount, then it is reversely rotated so as to leave a given uncut portion on the paper.

The printer of the invention having the arrangement as set forth above has the following effects.

The continuous paper is cut with leaving uncut portions at either side of the paper in the paper width direction within the same job and cut off the paper in the entire width direction upon completion of a series of jobs so that the printed paper having one job can be distinguished from the printed papers having other jobs without providing the stacker.

Since the printer can dispense with the paper having perforations or the special paper having slits, the paper can be cut with leaving the uncut portions by the cutter means provided in the printer, whereby the printed paper can be issued at real time, which improves the working efficiency remarkably.

What is claimed is:

1. Apparatus for producing discrete paper strip elements containing groupings of interconnected job-identification tabs from a continuous paper strip, comprising:

means for feeding a continuous paper strip having opposed, parallel edges along a feed path;

printing means fixedly disposed along said feed path and operative to print job-identification data images at longitudinally spaced locations along said strip;

cutting means fixedly disposed along said feed path downstream of said printing means, said cutting means including:

a cutter operative to produce a transverse cut in said strip;

cutting amount determining means effective to determine the extent of cut produced by said cutter during each operation thereof to selectively extend said cut completely between said strip edges to sever said strip into discrete elements or incompletely transversely of said strip edges to produce in each discrete element a plurality of partially severed tabs interconnected by unsevered paper; and cutter control means operative to move said cutter for cutting said strip from one edge or the other, said cutter control means cooperating with said cutting amount determining means and including first means operative to move said cutter repeatedly to produce a number of longitudinally spaced partial cuts in said strip corresponding to the number of job units to be identified, and second means operative to move said cutter to completely sever said strip to produce said discrete strip elements containing a grouping of interconnected job-identification tabs.

2. Apparatus according to claim 1, wherein said cutter is mounted for movement in alternate directions traversely of said strip, said cut progressing selectively in a transverse direction from one edge to the other, and said cutter control means moving said cutter in opposite cutting directions for cutting said strip selectively from one edge or the other, changing the cutting direction of said cutter for each successive job.

3. Apparatus according to claim 1 wherein said cutting amount determining means includes a plurality of sensors disposed at spaced locations transversely of the feed path of said strip including sensors at the terminal ends of movement of said cutter on opposite sides of said strip, and at least one sensor positioned intermediate said other sensors for determining the extent of movement of said cutter for producing said partial cuts.

4. Apparatus according to claim 3 wherein said sensors are mounted for adjustable movement transversely of said feed path.

5. Apparatus according to claim 2 including cutter direction discriminating means operative with a print control means to adjustably position said printing means for imposing said data images on said strip in a direction corresponding to the selected cutting direction of said cutter.

6. Apparatus according to claim 1 wherein said printing means includes means for printing data images like bar code symbols and said apparatus further comprises:

a verification means for verifying the data images imposed by said printing means on each job-identification tab, and an invalidity indication control means operative to move said cutter transversely of said strip to crosscut the defective data image by imposing a partial cut in the affected tab.

7. Apparatus according to claim 6, further comprising:

a reprint control means operative in cooperation with said verification means to operate said printing means for printing a corrected data image on the succeeding tab when a defective data image is detected by said verification means.

8. Apparatus for printing comprising:

means for imparting print data like a bar code on a continuous paper strip having opposed, substantially parallel edges and a cutter means for cutting the continuous paper strip in the paper width direction transversely of said edges upon completion of printing, and a verification means for verifying the print data which is printed by said printing means, and a means for operating said cutter means to crosscut the print data, which is detected as defective by said verification means, by cutting said continuous paper strip through said print data by an amount which is smaller than the entire paper width for forming a crosscut representing invalidity.

9. A method of sorting out job identification tabs produced by an apparatus comprising the steps of:

providing a printing means for printing print data on a continuous paper strip having opposed, substantially parallel strip edges and a cutter means for cutting the continuous paper strip in the paper width direction traversely of said edges upon completion of printing;

printing a plurality of job identification data images representative of a number of job units on the continuous paper strip by said printing means;

selectively partially cutting the continuous paper strip by said cutter means intermediate said printed job identification data images to produce residual uncut portions within a paper length indicative of a series of job units by cutting the paper strip a number of times corresponding to the number of job units by an amount which is smaller than the entire paper width; and cutting the paper strip by said cutter means by an amount extending the entire paper width after completion of said partial cutting step to designate the series of job units thereby sorting out the printed tabs according to the job.

* * * * *